US005947697A

United States Patent [19]

Morrison

[11] Patent Number: 5,947,697

[45] Date of Patent: Sep. 7, 1999

[54] MONOBLOCK GAS COMPRESSOR FOR PRESSURIZED GAS

[76] Inventor: Ronald L. Morrison, 12316 Shorehan Ct., Oklahoma City, Okla. 73170

[21] Appl. No.: 08/967,405

[22] Filed: Nov. 11, 1997

[51] Int. Cl.[6] ..... F04B 41/04

[52] U.S. Cl. ..... 417/237

[58] Field of Search ..... 417/53, 380, 364, 417/237; 230/231; 137/516.17; 123/41.01

[56] References Cited

U.S. PATENT DOCUMENTS

| | | | |
|---|---|---|---|
| 1,738,121 | 12/1929 | Schramm | 417/237 |
| 1,804,873 | 5/1931 | Hoffman | 417/237 |
| 1,992,400 | 2/1935 | Smith | 123/195 |
| 2,030,759 | 2/1936 | Neal | 230/187 |
| 2,394,904 | 2/1946 | Fowler | 230/56 |
| 3,365,014 | 1/1968 | Clingerman et al. | 180/54 |
| 3,462,074 | 8/1969 | Grimmer | 230/181 |
| 4,255,090 | 3/1981 | Pratt | 417/53 |
| 4,700,663 | 10/1987 | Dunn | 123/1 |
| 4,961,691 | 10/1990 | Waldrop | 417/237 |
| 5,400,751 | 3/1995 | Grimmer et al. | 123/192.2 |

OTHER PUBLICATIONS

Brochure, Triple Your Current Cash Flow!, Gas Jack, Inc., not dated.

Brochure, GrimmerSchmidt Compressors, MonoBlock Series, not dated.

Brochure, Iowa Mold Tooling Co., Porta–Air Air Compressors, not dated.

*Primary Examiner*—Charles G. Freay
*Assistant Examiner*—Robert Z. Evora
*Attorney, Agent, or Firm*—Dunlap, Codding & Rogers, P.C.

[57] ABSTRACT

A monoblock gas compressor for use in compressing gas having a supply pressure greater than the atmospheric pressure is provided. The compressor includes a compressor head mounted to a cylinder block such that a plurality of valve receiving bores formed in the cylinder head are aligned with a bank of cylinders of the cylinder block. A compressor valve is disposed in the valve receiving bores and secured therein with a valve retainer. The valve retainer defines a gas inflow path to the compressor valve and a gas discharge path away from the compressor valve. The compressor head has a plurality of gas inlets extending from a side of the compressor head and intersecting a corresponding one of the gas inflow paths, thereby enabling the compressor head to safely receive supply gas at a pressure substantially greater than atmospheric pressure.

10 Claims, 6 Drawing Sheets

MONOBLOCK GAS COMPRESSOR FOR PRESSURIZED GAS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to compressors, and more particularly, but not by way of limitation, to an improved monoblock gas compressor having a compressor head for safely containing supply gas having a pressure above atmospheric pressure and adaptable for multiple-stage compression.

2. Brief Description of the Related Art

The use of internal combustion engines which have had a portion thereof converted for use as a gas compressor is well known. Such compressors are known as monoblock compressors in that one engine cylinder block is utilized for both power and air compression. V-6 and V-8 engines are the engines most commonly used for a monoblock compressor with one bank of cylinders being used for power and the other bank of cylinders being used for compression. The engine is converted for compression by replacing the standard cylinder head and valve cover with a compressor head which is provided with a compressor valve so as to permit air to be sucked into the cylinder bore on the down stroke of the piston and compressed and discharged on the up stroke of the piston.

Monoblock compressors designed for compressing air do not require any type of sealed intake manifold due to the fact that the supply air is at atmospheric pressure. In contrast, when the pressure of the supply gas is greater than atmospheric pressure, the inlets to the compressor valves must be sealed. For example, natural gas produced from subterranean formations is generally at pressures greater than atmospheric pressure. Nevertheless, a compressor must often be employed to further compress the natural gas to facilitate its delivery to a gas gathering network.

A monoblock compressor for use with natural gas is disclosed in U.S. Pat. No. 4,961,691, issued to Waldrop. Waldrop discloses a monoblock gas compressor having an inlet manifold connected to a compressor head. The inlet manifold is provided with a pair of gas inlets and is adapted to cover the top of the compressor head in a manner similar to a conventional valve cover. A seal member, such as an O-ring or a gasket, is positioned between the inlet manifold and the compressor head to provide sealing engagement between the inlet manifold and the compressor head. The problem encountered is that the seal member is generally rated for pressures of 10–20 psig. Consequently, when utilizing the monoblock compressor of Waldrop, natural gas producers are limited in the pressure at which they can supply the natural gas to the compressor without fear of blowing out the seal member and having gas leak from the compressor and potentially being ignited by a spark from the engine or some other source. Gas can also leak past the seal member upon the seal member becoming worn or damaged. To this end, a need exists for an improved monoblock compressor having a compressor head for safely containing supply gas having a pressure above atmospheric pressure.

In addition, it is sometimes necessary to compress gas in multiple stages to obtain higher discharge pressures. In the past, multiple stage compression has required the use of a separate compressor for each stage of compression. In the case of using monoblock compressors for multiple stage compression, this results in an increase in equipment cost of two to three fold depending on the number of compression stages, as well as an increase in the cost of operating each of the compressors. Thus, a need also exists for a compressor head that is adaptable for multiple stage compression.

BRIEF SUMMARY OF THE INVENTION

The present invention is directed to a monoblock gas compressor. The gas compressor includes a cylinder block having a first bank of cylinders and a second bank of cylinders, a crankshaft rotatably disposed in the cylinder block, and a piston reciprocally disposed in each of the cylinders of the first and second banks. The first bank of cylinders is adapted to power the pistons disposed in the second bank of cylinders. A compressor head is mounted to the cylinder block so that a plurality of valve receiving bores formed therein are aligned with and correspond to the cylinders of the second bank. The compressor head has a plurality of gas inlets extending from a side of the compressor head and intersecting a corresponding one of the valve receiving bores. The compressor head also has a gas outlet extending from each of the valve receiving bores.

A compressor valve is disposed in each of the valve receiving bores and a valve retainer is secured in each of the valve receiving bores in sealing engagement with the compressor valve. The valve retainer defines an inlet flow path between the gas inlet and a suction portion of the compressor valve and a discharge flow path between a discharge portion of the compressor valve and the gas outlet.

In another aspect, the compressor head has a plurality of first stage valve receiving bores and at least one second stage valve receiving bore formed in the compressor head. The compressor head has a plurality of gas inlets extending from a side of the compressor head and intersecting a corresponding one of the first and second stage valve receiving bores, a first gas outlet in fluid communication with the first stage valve receiving bores, and a second gas outlet in fluid communication with the second stage valve receiving bore. The first gas outlet is connected to the gas inlet of the second stage valve receiving bore so as to establish fluid communication therebetween.

A compressor valve is disposed in each of the first and second stage valve receiving bores, and a valve retainer is secured in each of the first and second stage valve receiving bores in sealing engagement with the compressor valve. The valve retainers disposed in the first stage valve receiving bores define an inlet flow path between a corresponding gas inlet of the compressor head and the suction portion of the compressor valve and a discharge flow path between the discharge portion of the compressor valve and the first gas outlet of the first stage valve receiving bores. The valve retainer disposed in the second stage valve receiving bore defines an inlet flow path between the corresponding gas inlet of the compressor head and the suction portion of the compressor valve and a discharge flow path between the discharge portion of the compressor valve and the second gas outlet of the second stage valve receiving bore.

The objects, features and advantages of the present invention will become apparent from the following detailed description when read in conjunction with the accompanying drawings and appended claims.

BRIEF DESCRIPTION OF THE SEVERAL VIEWS OF THE DRAWING

FIG. 6 is a cross-section taken along lines 6—6 in FIG. 5.

DETAILED DESCRIPTION OF THE INVENTION

Figure 1:
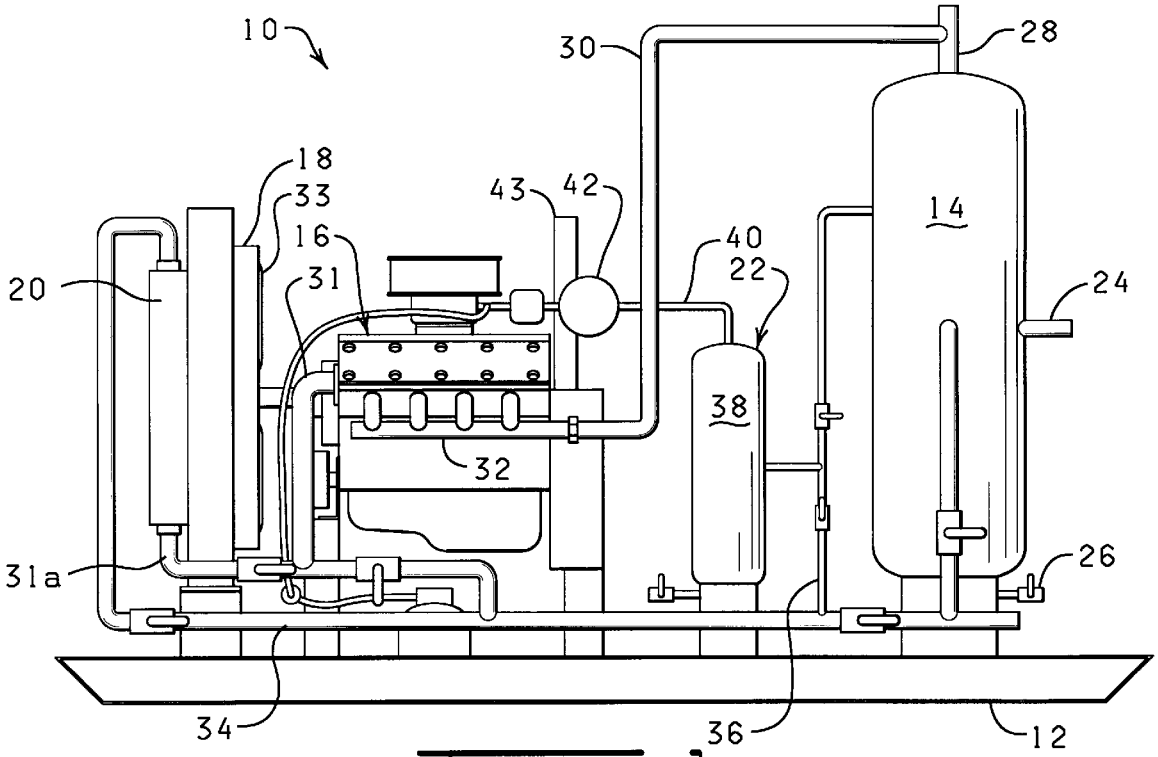
FIG. 1 is a side elevational view of a compressor unit employing a monoblock compressor constructed in accordance with the present invention.

Referring now to the drawings and more particularly to FIG. 1, a compressor unit 10 constructed in accordance with the present invention, is illustrated. The compressor unit 10 is particularly adapted for receiving natural gas from a well and compressing the natural gas for facilitating the delivery of the natural gas to a gas gathering network. The compressor unit 10 is mounted on a skid 12 and includes a liquid separator 14, a monoblock compressor assembly 16, a radiator 18, an aftercooler 20, and a compressor fuel assembly 22.

Fluid produced from a well is introduced into the liquid separator 14 via a separator inlet 24. The liquid separator 14 separates the fluid into a gas portion and a liquid portion. The liquid portion is discharged from the liquid separator 14 via a liquid outlet 26 and is disposed of or further processed in a conventional manner depending on the makeup of the liquid portion. The gas portion separated in the liquid separator 14 is discharged from the liquid separator 14 via a gas outlet 28. The gas is passed to the monoblock compressor assembly 16 via conduit 30 and manifold 32. The gas is compressed in the monoblock compressor assembly 16 and thereafter discharged from the monoblock compressor assembly 16. During the compression process, the gas is heated. Therefore, the compressed gas is passed from the monoblock compressor assembly 16 to the aftercooler 20 via conduit 31 and conduit 31a. The aftercooler 20, which functions to cool the gas, is a finned tube type and is mounted adjacent to the radiator 18 so as to take advantage of the fan 33 of the radiator 18. The fan 33 of the radiator 18 pulls air through the aftercooler 20 to help is cool the compressed gas. The cooled gas is discharged from the aftercooler 20 and passed to a gas gathering network (not shown) via a conduit 34.

In a typical field installation, the monoblock compressor assembly 16 will be fueled by gas from the well. In this instance, the compressor fuel assembly 22 includes a bypass conduit 36 provided between the conduit 34 and a liquid separator 38. From the liquid separator 38, fuel gas is passed to the carburetor of the monoblock compressor assembly 16 via a conduit 40. The conduit 40 is provided with a pressure regulator 42 for regulating the pressure of gas being introduced into the carburetor. A control panel 43 is provided for controlling and monitoring the operation the compressor unit 10. It will be appreciated that the control panel 43 contains conventional switches and gauges well known in the art. Thus, no further description of the control panel 43 is believed necessary in order to enable one skilled in the art to understand the construction and operation of the compressor unit 10 of the present invention.

Figure 2:
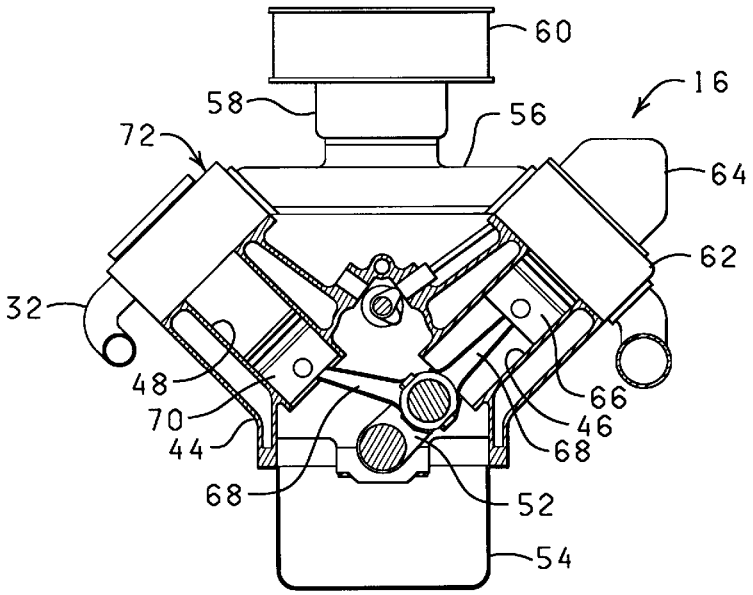
FIG. 2 is an end view of the monoblock compressor of the present invention.
Figure 3:
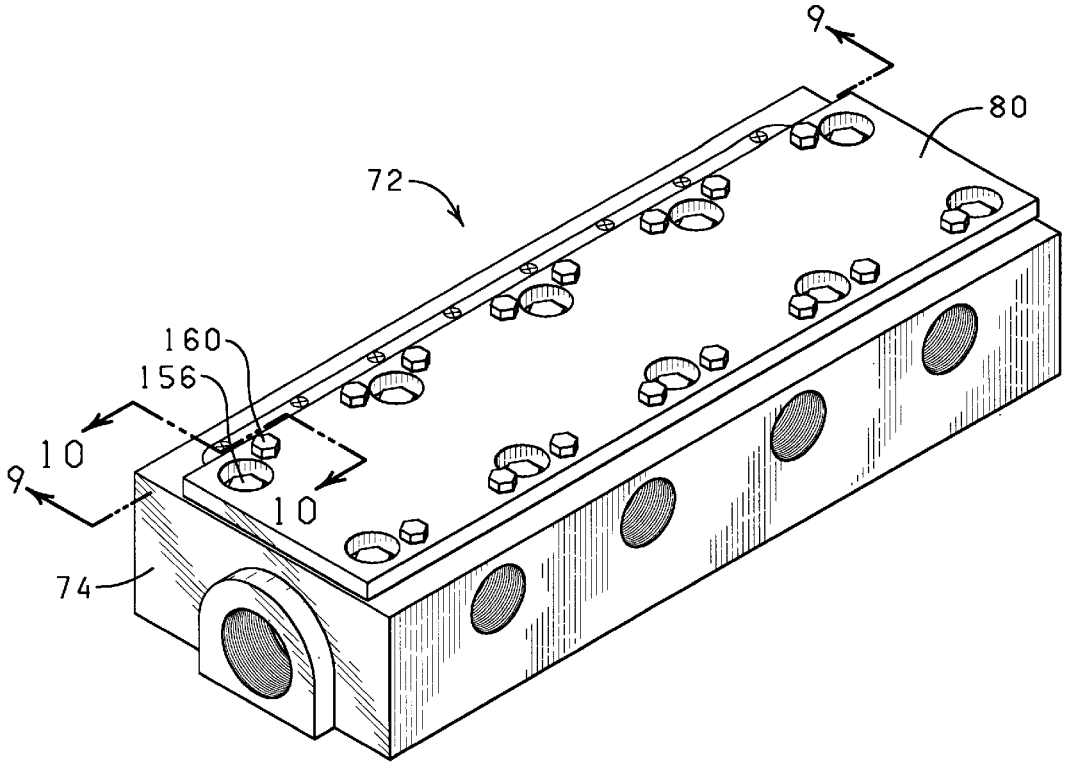
FIG. 3 is a perspective view of a compressor head assembly constructed in accordance with the present invention.

Referring now to FIG. 2, the monoblock compressor assembly 16 is constructed by modifying a known internal combustion engine, such as a V-6 or V-8 engine. To this end, the monoblock compressor assembly 16 includes a cylinder block 44 having a first bank of cylinders 46 and a second bank of cylinders 48. The monoblock compressor assembly 16 further includes a crankshaft 52 rotatably mounted in the cylinder block 44 and an oil pan 54 mounted to the lower end of the cylinder block 44. At the upper end of the cylinder block 44 is an air intake manifold 56 with a carburetor 58 and an air cleaner 60 connected thereto. A standard cylinder head 62 and valve cover 64, which contain normal engine components such as a valve train and spark plugs, are mounted to the cylinder block 44 over the first bank of cylinders 46.

Each cylinder of the first bank of cylinders 46 is provided with a piston 66 which is connected to the crankshaft 52 via a connecting rod 68. Each cylinder of the second bank of cylinders 48 is provided with a piston 70 which is connected to the crankshaft 52 via one of the connecting rods 68. As a consequence, the first bank of cylinders 46 operates as a power bank for driving the crankshaft 52 and thus causing the pistons 70 to reciprocate within the second bank of cylinders 48, whereby the reciprocating pistons 70 cooperate with a compressor head assembly 72, which is mounted on the cylinder block 44 over the second bank of cylinders 48 and is connected to the manifold 32 to effect the compression of gases received via the manifold 32.

Referring now to FIGS. 3–10, the compressor head assembly 72 will be described in greater detail. Broadly, the compressor head assembly 72 includes a compressor head 74, a plurality of compressor valves 76 (FIG. 4), a plurality of valve retainers 78 (FIG. 4), and a valve retainer plate 80.

Figure 5:
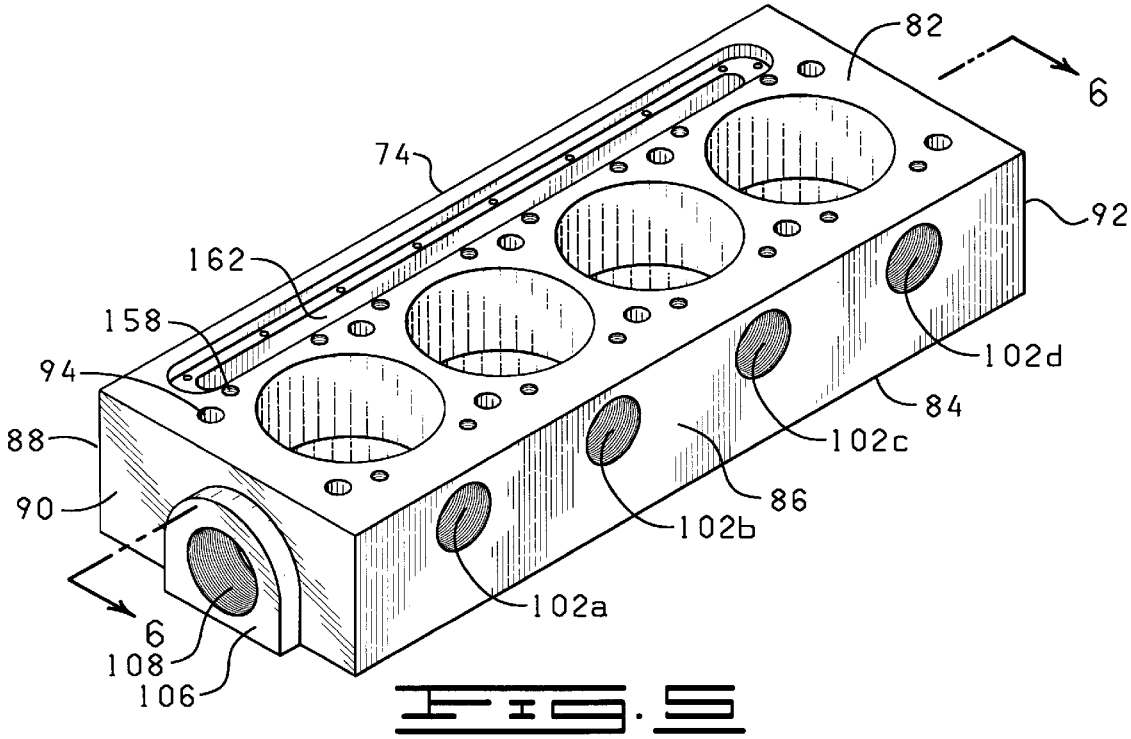
FIG. 5 is a perspective view of a compressor head.
Figure 4:
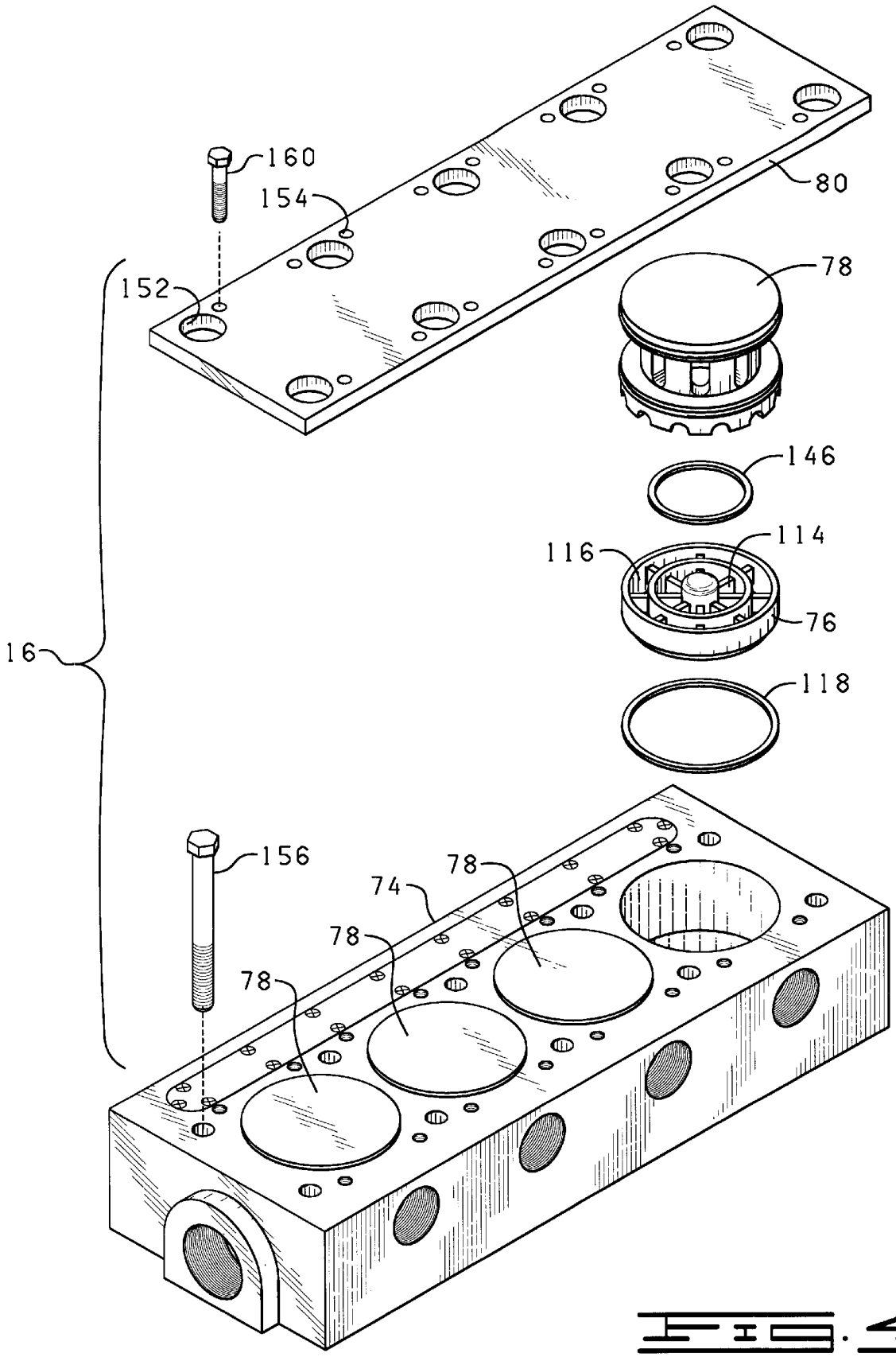
FIG. 4 is an exploded, perspective view of the compressor head assembly.
Figure 5:
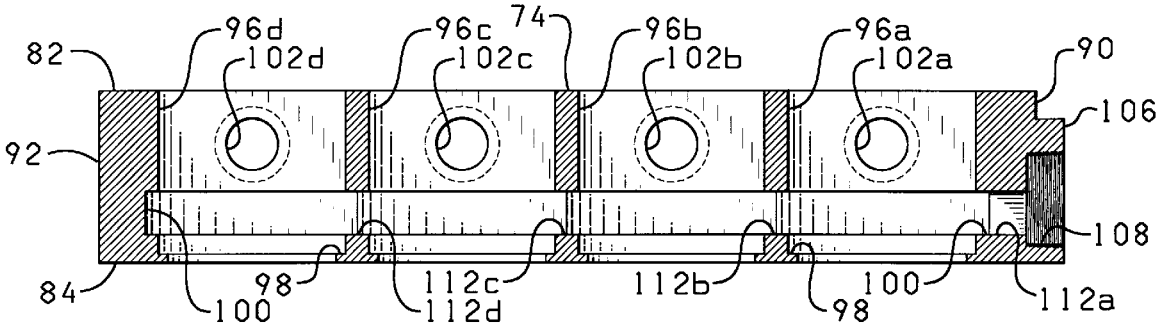

As best illustrated in FIGS. 4–6, the compressor head 74 is formed of a suitable metal, such as aluminum, and is characterized as having an upper end 82, a lower end 84, a front side 86, a rear side 88, a first end 90, and a second end 92. The lower end 84 is a substantially flat surface to facilitate seating of the compressor head 74 to the cylinder block 44. The compressor head 74 is provided with a plurality of bolt holes 94 (only one of which is designated in FIG. 5) which extend through the compressor head 74 from the upper end 82 to the lower end 84 and which are adapted to slidably receive bolts or other suitable connecting members for securing the compressor head 74 to the cylinder block 44. A sealing member, such as a gasket 95 (FIG. 8), is positioned between the compressor head 74 and the cylinder block 44 to provide a fluid tight seal between the cylinder head 74 and the cylinder block 44 when the cylinder head 74 is secured to the cylinder block 44.

The cylinder head 74 has a plurality of valve receiving bores 96*a*–96*d* (FIG. 6) which extend through the compressor head 74 from the upper end 82 to the lower end 84. The number of valve receiving bores 96 preferably corresponds to the number of cylinders in the second bank of cylinders 48, which is four in the embodiment illustrated herein. Each valve receiving bore 96*a*–96*d* has an internal support shoulder 98 formed a predetermined distance from the lower end 84 of the compressor head 74. Each of the valve receiving bores 96*a*–96*d* further has an annular recess 100 formed a distance above the internal support shoulder 98.

The compressor head 74 is provided with a plurality of gas inlets 102*a*–102*d*. To increase the pressure rating of the connection of the compressor head 74 and the manifold 32, each gas inlet 102 extends through the compressor head 74 from the front side 86 of the compressor head 74 and intersects a corresponding valve receiving bore 96*a*–96*d*. The gas inlets 102*a*–102*d* intersect the corresponding valve receiving bore 96*a*–6*d* at a location between the annular recess 100 and the upper end 82 of the compressor head 74. Each gas inlet 102*a*–102*d* has a threaded outer end for threaded engagement with the manifold 32.

A discharge flange 106 is formed on the first end 90 of the compressor head 74. The discharge flange 106 defines a gas outlet 108. The discharge flange 106 is threaded for threadingly receiving one end of the conduit 31. The valve receiving bore 96a is interconnected to the gas outlet 108 via a discharge outlet 112a, and the valve receiving bores 96*b*–96*d* are interconnected to the gas outlet 108 by a series of discharge outlets or passages 112*b*–112*d* provided between each adjacent pair of valve receiving bores 96*a*–96*d* to provide fluid communication between the gas outlet 108 and each of the valve receiving bores 96*a*–96*d*. As best shown in FIG. 6, the gas passages 112*a*–112*d* are formed through the compressor head 74 so as to intersect the annular recess 100 of each valve receiving bore 96*a*–96*d*.

Figure 8:
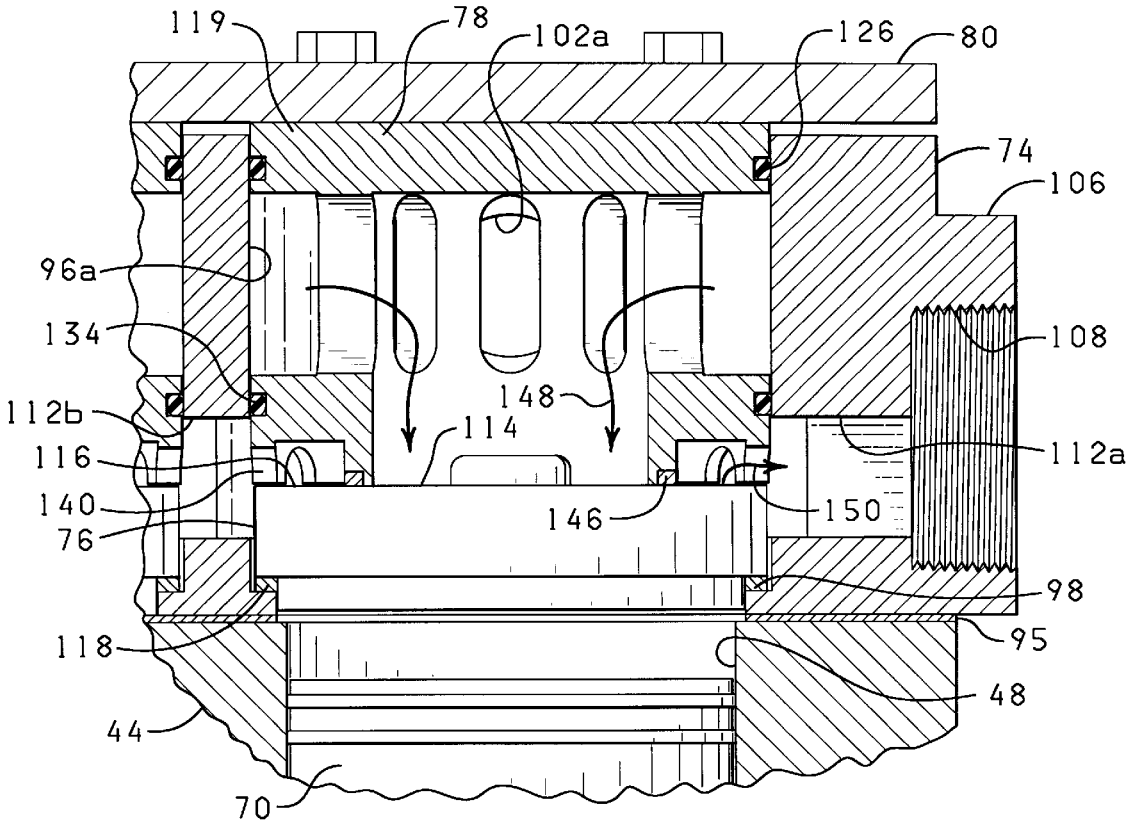
FIG. 8 is a fragmental, partially cross-sectional view illustrating the compressor head assembly mounted to the cylinder block.
Figure 9:
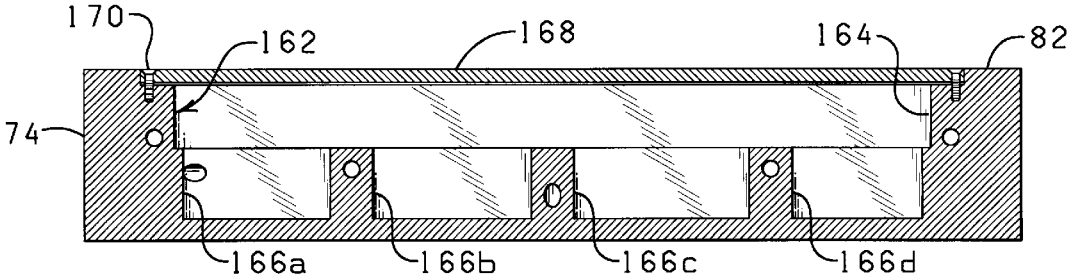
FIG. 9 is a cross-section taken along lines 9—9 in FIG. 3.
Figure 10:
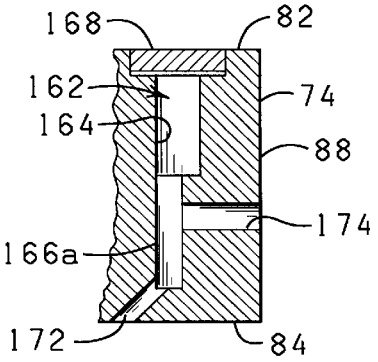
FIG. 10 is a cross-section taken along lines 10—10 in FIG. 3.

As shown in FIG. 8, each valve receiving bore 96*a*–96*d* (only valve receiving bore 96*a* is depicted in FIG. 8) is dimensioned to receive the compressor valve 76 such that the compressor valve 76 is supportingly disposed on the internal support shoulder 98. The compressor valve 76 is shown herein to be a conventional concentric, plate-type valve having a central suction portion 114 and an outer discharge portion 116. It will be appreciated that the suction portion 114 and the discharge portion 116 react to variations in pressure produced by the reciprocating movement of the pistons 70. That is, the pistons 70 cause a lowering of pressure in the cylinder during the down stroke or suction stroke, thereby causing the suction portion 114 to open and cause gas to be drawn into the respective cylinders of the second bank of cylinders 48. Then, when the pistons 70 begin to form their return stroke or compression stroke, the suction portion 114 closes because of the increase of pressure within the cylinder. When the pistons 70 complete the up stroke, the pressure of the gas compressed in the cylinder is at a pressure that causes the discharge portion 116 of the compressor valve 76 to open and allow gas to flow through the discharge portion 116. Concentric compressor valves, as briefly described above, are commercially available and well known in the art. Thus, no further description of the various types of compressor valves, their components or operation is believed necessary in order to enable one skilled in the art to understand the compressor assembly 16 of the present invention.

A seal member 118, such as a gasket, is disposed between the compressor valve 76 and the internal support shoulder 98 to effect a fluid tight seal between the compressor head 74 and the compressor valve 76.

Figure 7:
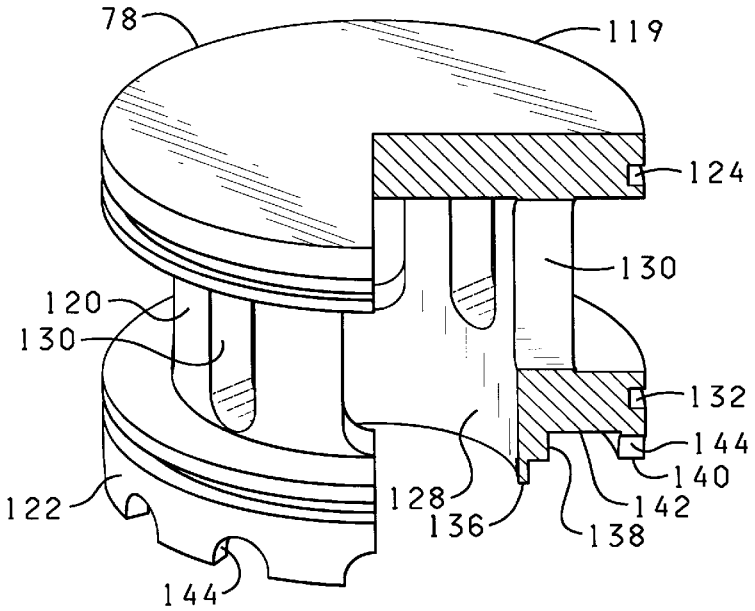
FIG. 7 is a partially cutaway, perspective view of a valve retainer.

Each of the valve retainers 78 is configured for abutting engagement with the compressor valve 76 for maintaining the compressor valve 76 in the valve receiving bores 96*a*–96*d* in cooperation with the valve retainer plate 80 and for defining an inlet passageway between the gas inlets 102*a*–102*d* and the suction portion 114 of the compressor valves 76 and an outlet passageway between the discharge portion 116 of the compressor valves 76 and the gas outlets 108 and 112. More specifically, the valve retainer 78, as best shown in FIG. 7, is a generally cylindrically shaped member which includes a cap portion 119, an intermediate portion 120, and a base portion 122. The cap portion 119 is substantially solid and is provided with an outer annular recess 124 for receiving a seal member 126. The outer diameter of the cap portion 119 is equal to the outer diameter of the base portion 122, while the outer diameter of the intermediate portion 120 is less than the outer diameters of the cap portion 119 and the base portion 122.

A central bore 128 extends through the intermediate portion 120 and the base portion 122. The intermediate portion 120 is provided with a plurality of spaced apart, elongated slots 130. The base portion 122 has an outer annular recess 132 for receiving a seal member 134 and an internal flange 136 which is dimensioned to be received by the suction portion 114 of the compressor valve 76. The base portion 122 further has an inner sidewall 138 and an outer sidewall 140 defining an annular cavity 142. The outer sidewall 140 is provided with a plurality of passages 144 spaced thereabout.

With the compressor valve 76 disposed in the valve receiving bore 96, the valve retainer 78 is disposed in the valve receiving bore 96 such that the base portion 122 of the valve retainer 78 is in abutting engagement with the compressor valve 76. A gasket 146 is disposed about the internal flange 136 to form a fluid tight seal between the valve retainer 78 and the compressor valve 76. The internal flange 136 seats within the suction portion 114 of the compressor valve 76 while the outer sidewall 140 engages the outer portion of the compressor valve 76. The valve retainer 78 is dimensioned so that the cap portion 119 extends beyond the upper end 82 of the compressor head 74 when the valve retainer 78 is engaged against the compressor valve 76, and yet the seal members 126 and 134 form a fluid tight seal between the valve retainer 78 and the compressor head 74. The seal members 126 and 134 along with the gasket 146, serve to define an inlet flow path 148 between the gas inlet 102 of the compressor head 74 and the suction portion 114 of the compressor valve 76 and a discharge flow path 150 between the discharge portion 116 of the compressor valve 76 and the discharge passage 108 or 112. That is, the valve retainer 78 is further dimensioned so that the gas inlet 102 of the compressor head 74 is isolated between seal members 126 and 134 and in fluid communication with the slots 130 of the intermediate portion 120 and the central bore 128 whereby the slots 130 and the central bore 128 define the inlet flow path 148, while the annular cavity 142 and passages 144 of the outer sidewall 140 define the discharge flow path 150.

The valve retainer plate 80 is disposed over the upper end 82 of the compressor head 74 so as to engage the cap portion 118 of the valve retainers 78 which are dimensioned to extend beyond the upper end 82 of the compressor head 74. Thus, the compressor valve 76 and the valve retainer 78 are maintained in sealing engagement with the compressor head 74 when the valve retainer plate 80 is secured to the upper end 82 of the compressor head 74. The valve retainer plate 80 is provided with a plurality of openings 152 and a plurality of openings 154. The openings 152 are alignable with the bolt holes 94 of the compressor head 74 and are sized to accommodate the heads of the bolts 156 used to secure the compressor head 74 to the cylinder block 44. The openings 154 are alignable with a plurality of threaded openings 158 formed in the upper end 82 of the compressor head 74. A plurality of threaded bolts 160 are in turn used to connect the valve retainer plate 80 to the upper end 82 of the compressor head 74.

To remove excess heat from the compressor head 74, the compressor head 74 is provided with a water chamber 162 located between the rear side 88 of the compressor head 74 and the valve receiving bores 96*a*–96*d*. The water chamber 162 includes an oblong upper portion 164 interconnecting a plurality of lower portions 166*a*–166*d* which are formed adjacent to and correspond with the valve receiving bores 96*a*–96*d*, respectively. The water chamber 162 is sealed with a cover 168 which is secured to the upper end 82 of the compressor head 74 with a plurality of connecting members, such as screws 170.

Water passes from the cylinder block 44 into the water chamber 162 via a plurality of inlets 172 (only one inlet 172 shown in FIG. 10) formed through the lower end 84 of the compressor head 74. After circulating through the water chamber 162, the water passes from the water chamber 162 into the radiator 18 via an outlet 174 formed through the rear end of the compressor head 74.

In operation, each of the gas inlets 102 of the compressor head 74 is coupled to a corresponding conduit of the manifold 32, thereby creating a sealed fluid pathway from the gas supply to the compressor valve 76 capable of withstanding pressures of approximately 3000 psi, and the conduit 31 is threadingly coupled to the discharge flange 106. Operation of the engine so as to cause the pistons 66 in the first bank of cylinders 46 to reciprocate and thus rotate the crankshaft 52 causes the pistons 70 to reciprocate within the second bank of cylinders 48. On their downstroke, the pistons 70 cause a lowering of pressure in the cylinders 48, thereby causing the suction portion 114 to open and allow gas to flow into the cylinders 48. Then, when the pistons 70 begin to form their return stroke or compression stroke, the suction portion 114 closes because of the increase of pressure within the cylinders 48. When the pistons 70 complete the up stroke, the pressure of the gas compressed in the cylinders 48 is at a pressure that causes the discharge portion 116 of the compressor valve 76 to open and allow gas to flow through the discharge portion 116.

Figure 11:
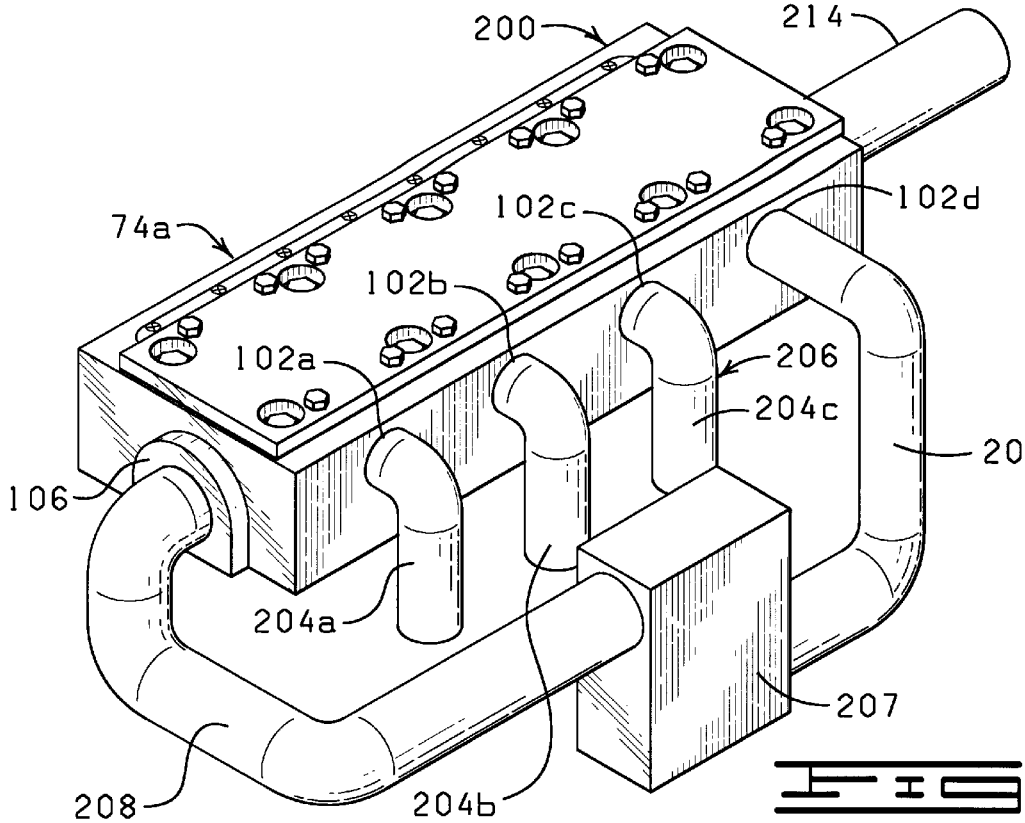
FIG. 11 is a perspective view of a multiple stage compressor head constructed in accordance with the present invention.
Figure 12:
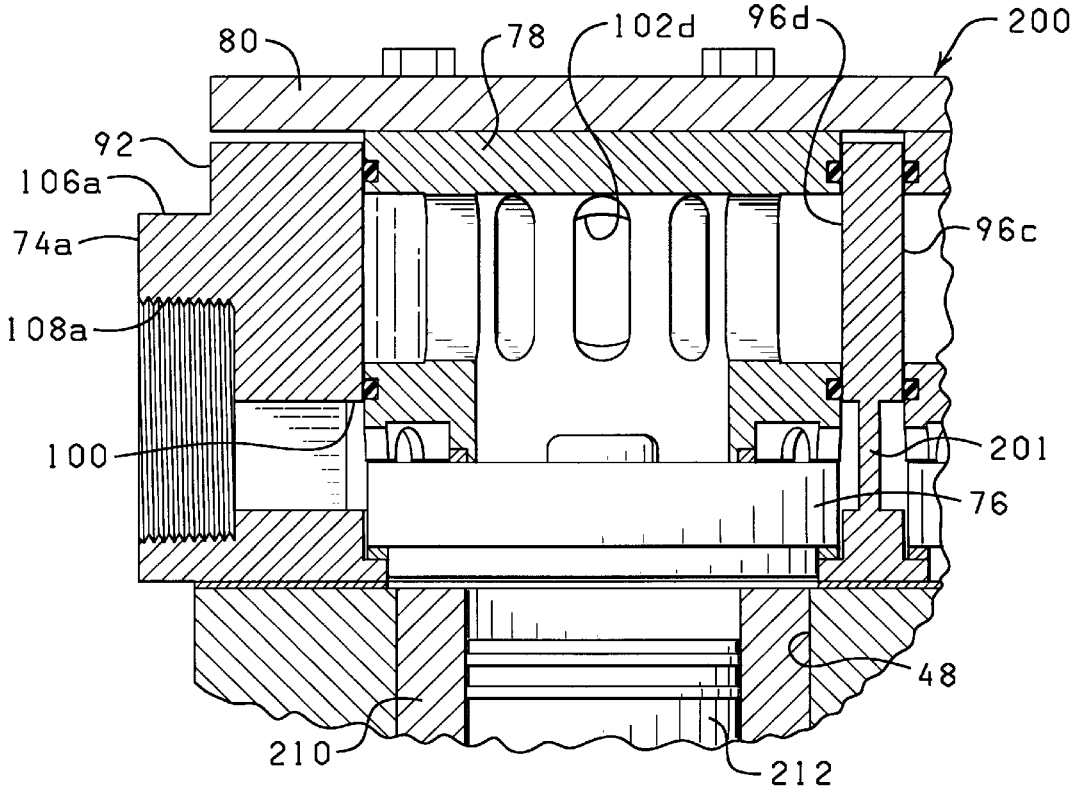
FIG. 12 is a fragmental, partial cross-sectional view of the compressor head of FIG. 11 showing the compressor head mounted to a cylinder block.

Referring now to FIGS. 11 and 12, another embodiment of a compressor head assembly 200 is illustrated. The compressor head assembly 200 is substantially identical in construction to the compressor assembly 16 described above except as noted below. Thus, like numerals are used to depict like components. The advantage of the below noted exceptions is that the compressor head assembly 200 is able to function as a two-stage compressor.

The compressor assembly 200 includes a compressor head 74*a*. The compressor head 74*a* is modified relative to the compressor head 74 in that the gas discharge outlet 112*d* provided between the valve receiving bores 96*c* and 96*d* is replaced in the compressor head 74*a* with a partition 201, thereby isolating the valve receiving bore 96*d* from the valve receiving bores 96*a*–96*c*. The compressor head 74*a* is further modified from the compressor head 74 in that the compressor head 74*a* is provided with a second discharge flange 106*a* which is formed on the second end 92 of the compressor head 74*a*. The discharge flange 106*a* defines a gas outlet 108*a* intersecting the annular recess 100 of the valve receiving bore 96*d*. The discharge flange 106*a* is threaded for threadingly receiving one end of the conduit 31.

When using the compressor head 74*a* for two-stage compression, inlet conduits 204*a*–204*c* of a manifold 206 are threadingly coupled to the gas inlets 102*a*–102*c*, as shown in FIG. 11, such that the cylinders 48 of the cylinder block 44 corresponding to the valve receiving bores 96*a*–96*c* are employed for a first stage of compression. The gas compressed during the first stage is passed into an aftercooler 207 via a conduit 208, and in turn, passed into the valve receiving bore 96*d*, which is employed for a second stage or compression, via a conduit 209.

It will be appreciated by those of ordinary skill in the art that the diameter of the cylinder 48 of the cylinder block 44 corresponding to the valve receiving bore 96*d* may need to be reduced relative to the diameter of the other cylinders to produce the desired compression ratios. Therefore, a reducing sleeve 210 can be inserted into the cylinder 48 corresponding to the valve receiving bore 96*d* to reduce the diameter of the cylinder 48. A piston 212 having a corresponding size is reciprocally disposed in the sleeve 210.

The gas compressed in the second stage of compression is discharged from the compressor head 74*a* and to another aftercooler, such as the aftercooler 20 (FIG. 1) via a conduit 214.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A supply of pressurized gas having a pressure greater than at least atmospheric pressure in combination with a gas compressor for compressing the pressurized gas, the gas compressor comprising:

a cylinder block having a first bank of cylinders and a second bank of cylinders;

a crankshaft rotatably disposed in the cylinder block;

an engine piston reciprocally disposed in each of the cylinders of the first bank, each of the engine pistons connected to the crankshaft and responsive to internal combustion for rotating the crankshaft;

a compressor piston reciprocally disposed in each of the cylinders of the second bank and connected to the crankshaft;

a compressor head mounted to the cylinder block and having a plurality of valve receiving bores formed therein which are aligned with and correspond to the cylinders of the second bank, the compressor head having a plurality of gas inlets for receiving the pressurized gas, each of the gas inlets extending from an exterior surface of the compressor head through the compressor head to a corresponding one of the valve receiving bores in a substantially perpendicular relationship to the corresponding valve receiving bores, the compressor head having a gas outlet extending from each of the valve receiving bores;

a compressor valve disposed in each of the valve receiving bores, each compressor valve having a suction portion and a discharge portion;

a valve retainer secured in each of the valve receiving bores in sealing engagement with the compressor valve, the valve retainer defining an inlet flow path between the gas inlet and the suction portion of the compressor valve and a discharge flow path between the discharge portion of the compressor valve and the gas outlet; and a gas inlet manifold connected to the compressor head to provide a sealed fluid pathway from the supply of pressurized gas to the compressor valves via the gas inlets of the compressor head.

2. The gas compressor of claim 1 wherein the intake manifold is threadingly connected to the compressor head.

3. The gas compressor of claim 1 wherein a portion of each valve retainer extends beyond an upper end of the compressor head and wherein the gas compressor further comprises a valve retainer plate secured to the upper end of the compressor head in engagement with the portion of the valve retainer to secure the valve retainer in the valve receiving bore of the compressor head.

4. The gas compressor of claim 1 wherein the compressor head further includes a water chamber for circulating water through the compressor head to remove excess heat.

5. The gas compressor of claim 4 wherein the water chamber is formed between a rear end of the compressor head and the valve receiving bores and the water chamber includes an oblong upper portion interconnecting a plurality of spaced apart lower portions, each lower portion of the water chamber corresponds to one of the valve receiving bores.

6. A supply of pressurized gas having a pressure greater than at least atmospheric pressure in combination with a multiple stage gas compressor for compressing the pressured gas, the gas compressor comprising:

a cylinder block having a first bank of cylinders and a second bank of cylinders;

a crankshaft rotatably disposed in the cylinder block;

an engine piston reciprocally disposed in each of the cylinders of the first bank, each of the engine pistons connected to the crankshaft and responsive to internal combustion for rotating the crankshaft;

a compressor piston reciprocally disposed in each of the cylinders of the second bank and connected to the crankshaft;

a compressor head mounted to the cylinder block and having a plurality of first stage valve receiving bores and at least one second stage valve receiving bore formed in the compressor head, each of the valve receiving bores aligned with and corresponding to one of the cylinders of the second bank, the compressor head having a plurality of gas inlets extending from an exterior surface of the compressor head through the compressor head to a corresponding one of the first and second stage valve receiving bores in a substantially perpendicular relationship to the corresponding first and second stage valve receiving bores, the compressor head having a first gas outlet in fluid communication with the first stage valve receiving bores and a second gas outlet in fluid communication with the second stage valve receiving bore, the first gas outlet connected to the gas inlet of the second stage valve receiving bore to establish fluid communication between the first gas outlet and the gas inlet of the second stage valve receiving bore;

a compressor valve disposed in each of the first and second stage valve receiving bores, each compressor valve having a suction portion and a discharge portion;

a valve retainer secured in each of the first and second stage valve receiving bores in sealing engagement with the compressor valve, the valve retainers disposed in the first stage valve receiving bores defining an inlet flow path between a corresponding gas inlet of the compressor head and the suction portion of the compressor valve and a discharge flow path between the discharge portion of the compressor valve and the first gas outlet of the first stage valve receiving bores and the valve retainer disposed in the second stage valve receiving bore defining an inlet flow path between the corresponding gas inlet of the compressor head and the suction portion of the compressor valve and a discharge flow path between the discharge portion of the compressor valve and the second gas outlet of the second stage valve receiving bore; and a gas inlet manifold connected to the compressor head to provide a sealed fluid pathway from the supply of pressurized gas to the compressor valves disposed in the first stage valve receiving bores via the gas inlets of the compressor head corresponding to the first stage valve receiving bores.

7. The gas compressor of claim 6 wherein the intake manifold is threadingly connected to the compressor head.

8. The gas compressor of claim 6 wherein a portion of each valve retainer extends beyond an upper end of the compressor head and wherein the gas compressor further comprises a valve retainer plate secured to the upper end of the compressor head in engagement with the portion of the valve retainer to secure the valve retainer in the valve receiving bore of the compressor head.

9. The gas compressor of claim 6 wherein the compressor head further includes a water chamber for circulating water through the compressor head to remove excess heat.

10. The gas compressor of claim 9 wherein the water chamber is formed between a rear end of the compressor head and the valve receiving bores and the water chamber includes an oblong upper portion interconnecting a plurality of spaced apart lower portions, each lower portion of the water chamber corresponds to one of the valve receiving bores.

* * * * *

UNITED STATES PATENT AND TRADEMARK OFFICE

CERTIFICATE OF CORRECTION

PATENT NO. : 5,947,697

DATED : September 7, 1999

INVENTOR(S) : Ronald L. MORRISON

It is certified that error appears in the above-identified patent and that said Letters Patent is hereby corrected as shown below:

In the Drawings:

FIG. 4, please delete the numeral "16" and substitute therefor the numeral --72--.

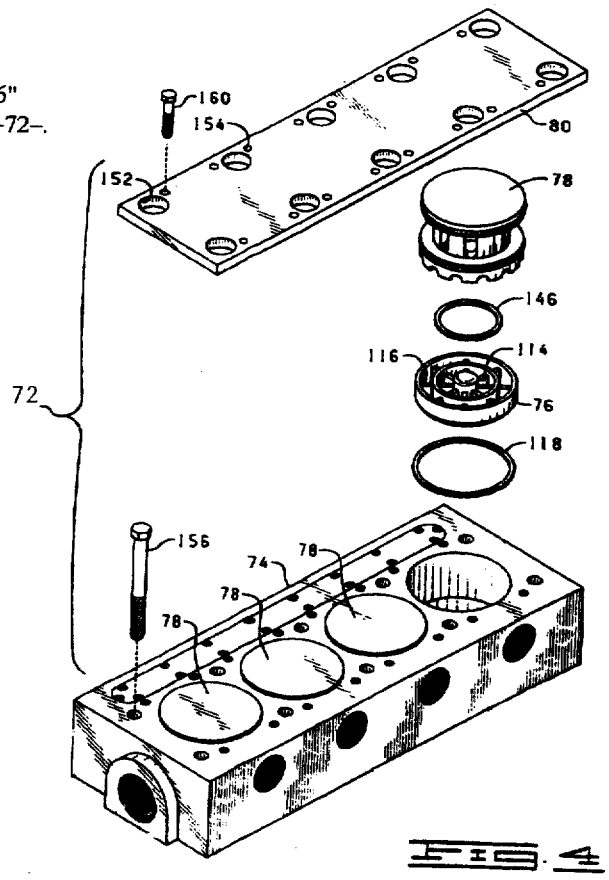

FIG. 4

UNITED STATES PATENT AND TRADEMARK OFFICE

CERTIFICATE OF CORRECTION

PATENT NO. : 5,947,697

DATED : September 7, 1999

INVENTOR(S) : Ronald L. MORRISON

It is certified that error appears in the above-identified patent and that said Letters Patent is hereby corrected as shown below:

Col. 3: line 64, delete "is",

Col. 5: line 17, delete "***96a*-6d" and substitute therefor --*96a-96d*--, Col. 6: line 59, delete "118", and substitute therefor --119**--, Col. 9: line 10 (line 1 of claim 2), delete "intake" and substitute therefor --inlet--, and Col. 10: line 35 (line 1 of claim 7), delete "intake" and substitute therefor --inlet--.

Signed and Sealed this

Fifth Day of December, 2000

*Attest:*

*Attesting Officer*

Q. TODD DICKINSON

*Director of Patents and Trademarks*